US010709179B2

(12) United States Patent
Behrend et al.

(10) Patent No.: US 10,709,179 B2
(45) Date of Patent: Jul. 14, 2020

(54) PROTECTIVE APPARATUS HAVING AN IMPACT ATTENUATION COMPONENT

(71) Applicant: NIKE, Inc., Beaverton, OR (US)

(72) Inventors: Carl Behrend, Portland, OR (US); Oliver McLachlan, Portland, OR (US); Catherine F. Morrison, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 304 days.

(21) Appl. No.: 15/188,673

(22) Filed: Jun. 21, 2016

(65) Prior Publication Data

US 2016/0316827 A1 Nov. 3, 2016

Related U.S. Application Data

(63) Continuation-in-part of application No. 13/804,758, filed on Mar. 14, 2013, now Pat. No. 9,370,208, and a continuation-in-part of application No. 14/955,784, filed on Dec. 1, 2015, which is a continuation-in-part of application No. 13/804,728, filed on Mar. 14, 2013, now Pat. No. 9,198,471.

(51) Int. Cl.
*A41D 13/015* (2006.01)
*A63B 71/12* (2006.01)

(52) U.S. Cl.
CPC ..... *A41D 13/015* (2013.01); *A41D 13/0153* (2013.01); *A63B 71/1225* (2013.01); *A63B 71/12* (2013.01); *A63B 2071/125* (2013.01); *A63B 2071/1233* (2013.01); *A63B 2071/1241* (2013.01); *A63B 2071/1258* (2013.01)

(58) Field of Classification Search
CPC .. A41D 13/015; A41D 13/06; A41D 13/0518; A41D 13/08; A41D 31/0055; A41D 31/0044; A63B 71/12; A63B 71/1225; A63B 2071/1258; A63B 2071/1233; A63B 2071/125; A63B 2071/0063
USPC ..... 2/2.5
See application file for complete search history.

(56) References Cited

U.S. PATENT DOCUMENTS 1,689,558 A 10/1928 Patten
3,016,317 A * 1/1962 Brunner ..... A63C 19/04 156/219

(Continued)

FOREIGN PATENT DOCUMENTS

DE 382722 C 10/1923
DE 29710131 U1 9/1997

(Continued)

OTHER PUBLICATIONS

European Search Report dated Sep. 30, 2016 for European Patent Application No. 14774625.9, 8 pages.

(Continued)

*Primary Examiner* — Jameson D Collier
*Assistant Examiner* — Jocelyn Bravo
(74) *Attorney, Agent, or Firm* — Shook, Hardy & Bacon, L.L.P.

(57) ABSTRACT

Aspects of the present invention relate to a protective apparatus that includes an impact shell and an impact attenuating component, which is less rigid than the impact shell. The impact attenuation component may include a series of channels or grooves on a posterior side, facing away from the impact shell.

12 Claims, 5 Drawing Sheets

(56) References Cited

U.S. PATENT DOCUMENTS 4,354,280 A 10/1982 Hayes
4,484,360 A 11/1984 Leighton et al.
4,525,875 A * 7/1985 Tomczak ..... A41D 13/0518 2/2.5
4,627,108 A 12/1986 Jarvinen
4,868,926 A * 9/1989 Lowson ..... A63B 71/1225 2/22
5,007,111 A * 4/1991 Adams ..... A41B 11/02 2/22
5,062,433 A 11/1991 Kummer et al.
5,160,785 A * 11/1992 Davidson, Jr. ..... A47C 27/146 297/DIG. 1
5,301,370 A * 4/1994 Henson ..... A63B 71/1225 2/22
5,405,312 A * 4/1995 Jacobs ..... A41D 13/0568 128/892
5,446,926 A 9/1995 Bourque et al.
5,477,558 A * 12/1995 Volker ..... A41D 13/0153 2/16
5,581,805 A 12/1996 Rennick et al.
5,924,140 A 7/1999 Chi
6,065,152 A 5/2000 Parker
6,093,468 A * 7/2000 Toms ..... A41D 13/0158 2/22
6,105,164 A 8/2000 Huang
6,151,714 A 11/2000 Pratt et al.
6,161,222 A 12/2000 Strickland et al.
6,247,745 B1 6/2001 Carroll, III et al.
6,432,513 B1 8/2002 Thomsen et al.
6,519,781 B1 2/2003 Berns
6,969,548 B1 11/2005 Goldfine
8,141,169 B2 * 3/2012 Saranga ..... A41D 13/065 2/22
8,769,715 B2 * 7/2014 Bergmann ..... A63B 71/1225 2/22
2002/0162162 A1 * 11/2002 Collins ..... A41D 13/0158 2/463
2003/0088900 A1 5/2003 Cho
2004/0181850 A1 9/2004 Beland
2005/0108800 A1 5/2005 White
2005/0114976 A1 6/2005 Beland et al.
2006/0096000 A1 5/2006 Romero et al.
2006/0179538 A1 8/2006 Dodd
2006/0277644 A1 12/2006 Dobkin
2008/0189822 A1 8/2008 Johannessen et al.
2009/0070911 A1 * 3/2009 Chang ..... A41D 13/0543 2/24
2009/0100563 A1 4/2009 Behrend et al.
2010/0205724 A1 8/2010 Kamradt
2011/0041227 A1 * 2/2011 Bergmann ..... A63B 71/1225 2/22
2011/0113559 A1 5/2011 Dodd
2011/0281083 A1 11/2011 Kim
2012/0030850 A1 2/2012 Wood
2012/0084896 A1 * 4/2012 Wyner ..... A63B 71/08 2/16
2012/0180183 A1 7/2012 Mechling et al.
2012/0272426 A1 11/2012 Dodd
2012/0291188 A1 11/2012 Grosstesner
2013/0232674 A1 9/2013 Behrend et al.
2013/0234376 A1 9/2013 Frey et al.
2013/0318675 A1 12/2013 Mackey
2014/0259324 A1 9/2014 Behrend et al.
2014/0259325 A1 9/2014 Behrend et al.

FOREIGN PATENT DOCUMENTS

DE 202016101863 U1 4/2016
JP 2007321262 A 12/2007
JP 2008214841 A 9/2008
JP 2009011545 A 1/2009
JP 2010230239 A 10/2010
WO 2013040488 A1 3/2013

OTHER PUBLICATIONS

International Search Report and Written Opinion dated Sep. 20, 2017 in International Patent Application No. PCT/US2017/038528, 14 pages.
European Office Action dated Mar. 8, 2017 for European Patent Application No. 14775365.3, 3 pages.
Japanese Office Action dated Dec. 13, 2016 in Japanese Patent Application No. 2016-500876, 5 pages.
Japanese Office Action dated Dec. 13, 2016 in Japanese Patent Application No. 2016-500877, 5 pages.
European Search Report dated Jun. 27, 2016 for European Patent Application No. 14775265.3, 6 pages.
International Preliminary Report on Patentability dated Jan. 3, 2019 in International Patent Application No. PCT/US2017/038528, 8 pages.

* cited by examiner

PROTECTIVE APPARATUS HAVING AN IMPACT ATTENUATION COMPONENT

CROSS-REFERENCE TO RELATED APPLICATIONS

This application is a continuation-in-part of U.S. patent application Ser. No. 13/804,758 (filed on Mar. 14, 2013) and is a continuation-in-part of U.S. patent application Ser. No. 14/955,784 (filed on Dec. 1, 2015). In addition, U.S. patent application Ser. No. 14/955,784 is a continuation-in-part of Ser. No. 13/804,728 (filed on Mar. 14, 2013, and issued as U.S. Pat. No. 9,198,471). The respective disclosure of U.S. patent application Ser. Nos. 13/804,758 and 14/955,784 is incorporated herein by reference in its entirety. In addition, priority is claimed to U.S. patent application Ser. No. 13/804,758, U.S. patent application Ser. No. 14/955,784, and U.S. patent application Ser. No. 13/804,728, such that the effective filing date of Mar. 14, 2013, is claimed.

BACKGROUND

A protective apparatus is traditionally used to limit an impact force experienced by a person or an object. A protective apparatus dissipates and attenuates an impact force as well as resists a puncture or impalement. Consequently, a protective apparatus, such as a shin guard, utilizes an exterior impact shell in combination with an impact attenuating structure, such as foam padding. The impact shell is generally formed from a rigid material that is resistant to punctures and impalements and is also capable of distributing an impact force across a larger area of the impact attenuating structure.

SUMMARY

This disclosure describes a protective apparatus that is comprised of an impact shell and an impact attenuating component. In one exemplary aspect, the impact attenuation component includes a series of channels or grooves on a posterior side.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Embodiments of the present invention relate to a protective apparatus that is comprised of an impact shell and an impact attenuating structure. The impact attenuation structure is generally coupled to the posterior side of the impact shell. In addition, the posterior surface of the impact attenuation structure includes a series of grooves or channels that face towards a user when the protective apparatus is worn. The impact shell may include various components, and various exemplary impact shells are described in other parts of this disclosure. For example, the impact shell may have an integral lattice that provides a set-off against the anterior side of the impact attenuating structure. In other aspects, the impact shell may include multiple shell portions that are hingedly coupled to one another on an anterior side of the impact attenuation structure.

Overview of an Exemplary Protective Apparatus

Having briefly described an overview of embodiments of the present invention, a more detailed description follows.

The protective apparatus is contemplated as providing protection to one or more portions of a body or object. For example, it is contemplated that a protective apparatus implementing one or more aspects provided herein may be utilized to provide protection and/or force damping functions to a variety of body parts. Examples include, but are not limited to, shin guards, knee pads, hip pads, abdominal pads, chest pads, shoulder pads, arm pads, and elbow pads, for example. Therefore, it is contemplated that aspects provided herein may be useful in a variety of situations at a variety of locations.

A protective apparatus, as provided herein, is an article for reducing an effect of an impact force on an associated portion of a wearer. For example, a shin guard utilizing features discussed herein may reduce the perception of energy imparted on the shin region of a user through the use of the protective apparatus. This change in perception may be accomplished in a variety of ways. For example, the energy applied at a point of impact may be distributed over a greater surface area, such as through a rigid impact shell. Further, it is contemplated that a dissipating/absorbing material may provide a compressive function for absorbing and/or dissipating a portion of the impact force.

Figure 1:
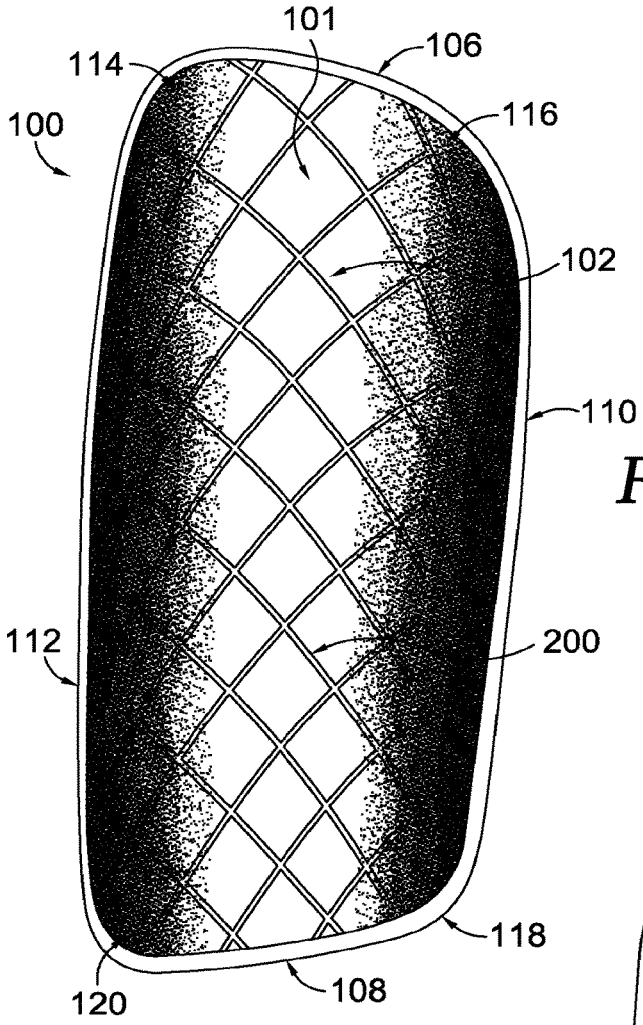
FIG. 1 illustrates an anterior view of an exemplary protective apparatus, in accordance with aspects of the present invention.
Figure 9:
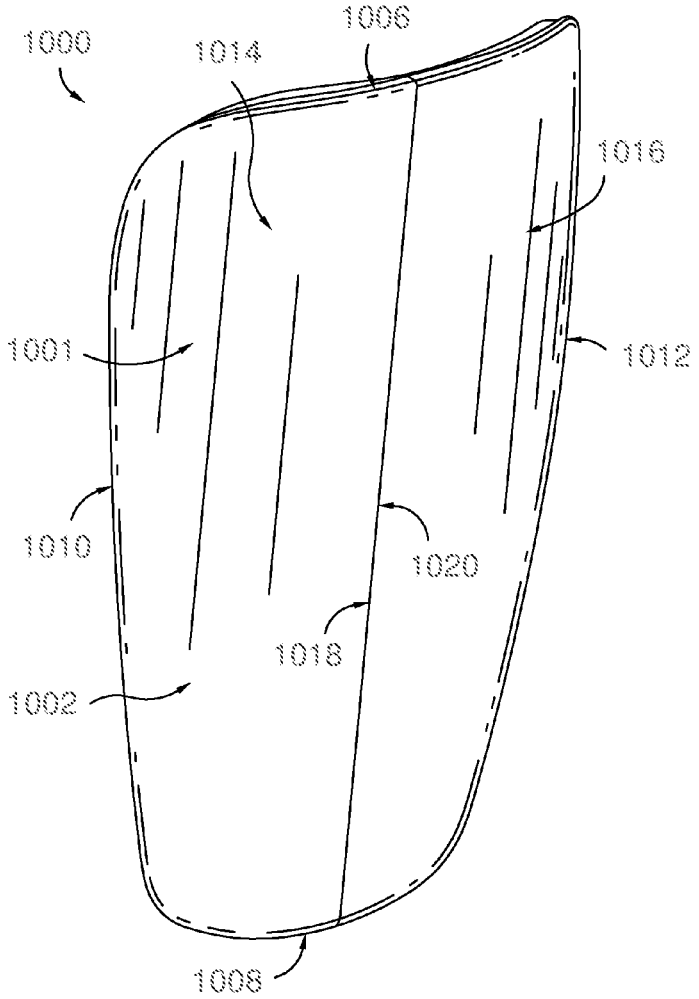
FIG. 9 illustrates another type of impact shell that is an alternative to the shell depicted in FIG. 1 and that might be coupled with an impact attenuation structure, in accordance with aspects of the present invention.

FIG. 1 illustrates an anterior view of an exemplary protective apparatus 100 in accordance with aspects of the present invention. It should also be noted that another exemplary protective apparatus 1000 is depicted in FIG. 9. In these illustrations, the protective apparatus is a shin guard intended to protect the tibia bone of a wearer and the calf region surrounding the shin from an impact force. As can be appreciated by one of skill in the art, a shin guard may be produced in a right-leg orientation and a left-leg orientation. Therefore, while one or more orientations are depicted, it is contemplated that concepts similar to those discussed and depicted may be translated to the opposite orientation. Stated differently, while a right shin guard may be discussed herein, it is contemplated that a left shin guard having a mirror-image orientation is also contemplated. Further, human anatomical relational terms are used herein (e.g., medial, lateral, superior, inferior, posterior, and anterior) as general locational terms for reference. However, it is contemplated that alternative aspects may be implemented that are contrary to the terms meaning with respect to a human body. Stated differently, a medial edge of a protective apparatus is contemplated, in an exemplary aspect, of being located proximate a lateral relative location on the wearer, for example.

The protective apparatus 100 is comprised of an impact shell 101 (also called a "shell" hereinafter) and an impact attenuating structure (not depicted). The shell 101 is comprised of a perimeter that may be defined, in part, by a superior edge 106, an opposite inferior edge 108, a medial edge 110, and an opposite lateral edge 112. Based on the general edge locations, regions of the protective apparatus may be defined, such as a superior lateral portion 114, a superior medial portion 116, an inferior medial portion 118, and an inferior lateral portion 120. Each of these portions refers to a general location and are not specific points on the protective apparatus 100. As will be discussed later, elements of a structural lattice 200 (hereinafter referred to as a "lattice") may be described as extending from the general direction of one or more of these regions to one or more alternative regions.

As is typical for a shin guard, the protective apparatus 100 has a general curve defined as extending from a posterior surface (e.g., closest to the wearer when in an as-worn position) in the direction of an anterior surface 102. Stated differently, the protective apparatus generally curves such that the center (e.g., origin) of the curve is on the posterior side rather than the anterior side. Consequently, the protective apparatus is able to wrap around a portion of a wearer's leg when in an as-worn position.

The shell 101, in an exemplary aspect, is formed from a rigid or semi-rigid material that is effective to distribute an impact force across an area of the protective apparatus. Further, the shell 101 is formed from a material that is functional to resist a puncture force exerted by an object, such as an opposing athlete's shoe cleat(s). Therefore, the shell 101 is manufactured from a material that is resilient enough to withstand an impact force and also able to deflect a potential impalement. Materials contemplated for manufacturing the shell 101 include, but are not limited to, a polypropylene material, a styrene-butadiene copolymer material, a carbon fiber-based material, other polymer-based materials, metallic materials, laminates, and other materials commonly utilized in the manufacture of a protective apparatus. In an exemplary aspect, a styrene-butadiene copolymer material may be utilized to provide a transparent shell that allows a wearer to detect wear and damage to the shell and the anterior surface of the impact attenuating structure without requiring a disassembly of the protective apparatus. Further, it is contemplated that a transparent shell also allows for verification of proper alignment of the shell and the impact attenuating structure at the time of coupling. As will be discussed later, it is contemplated that an alignment of one or more channels of the impact attenuating structure may occur with the ribs of the lattice on the shell, which may be visibly aligned with a transparent shell, in an exemplary aspect.

However, as will be discussed hereinafter, a portion of a transparent shell may be masked to obscure materials on the posterior side of the shell. For example, an adhesive used to couple the shell and the impact attenuating structure may be obscured by a graphical element, such as a colorant, paint, dye, laminate, decal, and the like that is applied to the shell. An exemplary masking/obscuring of a portion of an otherwise transparent shell is depicted in FIG. 1, such that a gradient or other obscuring pattern may be implemented that extends from the medial and lateral sides toward the interior/middle of the shell, as will be discussed in greater detail with respect to FIG. 3 hereinafter.

Exemplary Impact Attenuation Structure

Figure 4:
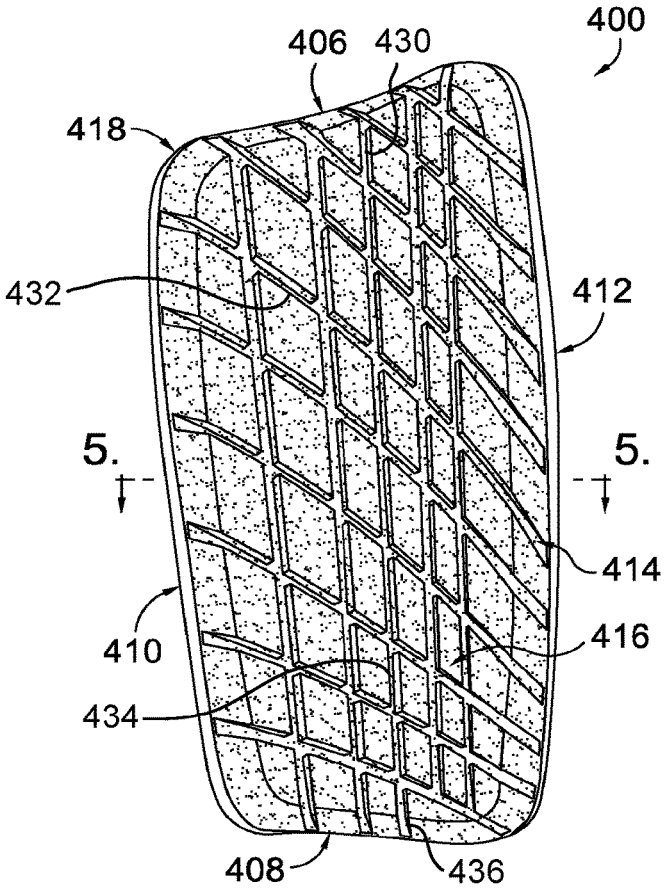
FIG. 4 illustrates a posterior perspective of an exemplary impact attenuating structure, in accordance with aspects of the present invention.
Figure 10:
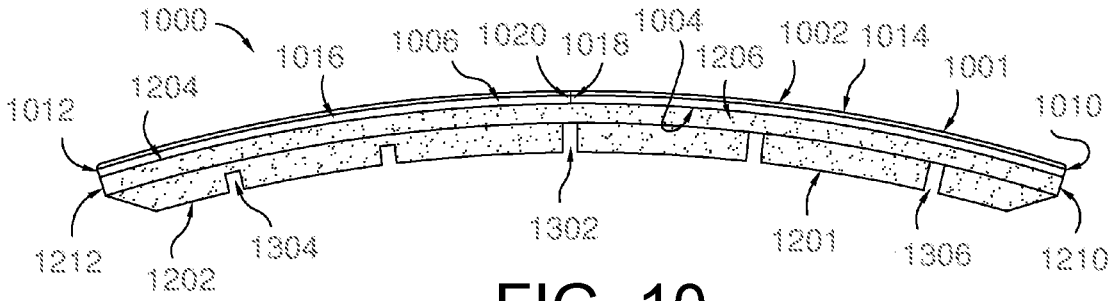
FIG. 10 depicts a top down view of the impact shell depicted in FIG. 9.

Referring to FIG. 4, a posterior perspective of an exemplary impact attenuating structure 400 is illustrated in accordance with aspects of the present invention. The impact attenuating structure 400 might be coupled with various types of impact shells, such as the shell 101 depicted in FIG. 1 and the shell 1001 depicted in FIG. 9. The impact attenuating structure 400 is comprised of a superior edge 406, an opposite inferior edge 408, a medial edge 410, and an opposite lateral edge 412. A posterior surface 416 of the impact attenuating structure 400 is illustrated. A plurality of channels 414 are recessed from the posterior surface 416. While not visible in FIG. 4, but will be discussed with respect to FIG. 5 hereinafter, a shell is coupled to an anterior surface 418 of the impact attenuating structure 400. In addition, FIG. 10 depicts another type of shell 1001 that might be coupled to the impact attenuation structure 400. FIG. 4 depicts a first set of channels (e.g., channel 430) that extend longitudinally from near the superior edge 406 to near the inferior edge 408. In addition, FIG. 4 depicts a second set of channels (e.g., channel 432) that extends diagonally across the posterior surface and that intersects with the first set of channels.

Figure 5:
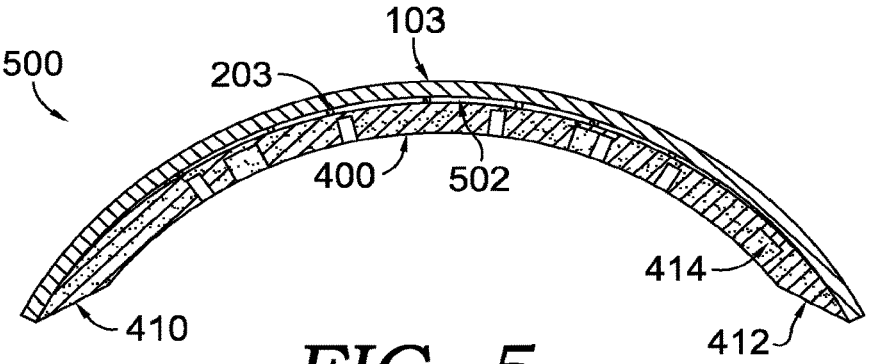
FIG. 5 illustrates a cross-sectional view of a protective apparatus comprised of the impact attenuating structure in FIG. 4 along cutline 5-5, in accordance with aspects of the present invention.

The channels 414 may be arranged at any location, at any depth, of any length, of any shape, and of any combination. For example, the variations in depth for the channels may be utilized to provide specific functions, such as desired impact attenuation, ventilation, weight, balance, feel, fit, and the like. Further, it is contemplated that channels proximate the medial portion of a shell may have a smaller depth (recessed amount) than those channels proximate the lateral portion of the shell. This type of varied-channel-depth configuration is illustratively depicted in FIG. 10 with the impact shell 1001, and it is understood that various different impact shells might also be coupled to an impact attenuation structure having channels with varied depths. In an exemplary aspect, the posterior surface of the medial portion of the impact attenuating structure is positioned on a tibia of a wearer when in an as-worn position. As such, it is contemplated that a greater volume of impact attenuating material proximate the tibia provides a better attenuation. Similarly, those channels on the lateral portion of the impact attenuating structure that are in more contact with muscle and flesh (non-bone structures) may not require as much impact attenuating material and therefore a reduction in weight and improved ventilation characteristics may be achieved with a deeper (greater recessed) channel in that portion. As such, the impact attenuating structure may be configured with a larger distribution of the impact attenuating structure on the medial side of the impact attenuating structure than on the lateral side of the impact attenuating structure. In a further aspect, a channel may include varied channel depths at different portions of the channel. For example, the channel 430 includes a first portion 434 and a second portion 436, the second portion 436 being located closer to the periphery edge of the impact attenuating structure. As depicted in FIG. 4, the second portion 436 includes a groove depth that is less than a groove depth of the first portion 434, such that the groove depth of the groove 430 tapers from a deeper groove portion 434 to a shallower groove portion 436. In addition, a thickness of the impact attenuation structure may also taper near the peripheral edge, as depicted in FIGS. 5 and 10.

The impact attenuating structure 400 may be formed from any material suitable for an impact attenuating structure. For example, it is contemplated that a foam material may be utilized. Further, it is contemplated that a laminate material having an outer layer (e.g., a "skin") may surround a foam core. In an exemplary aspect, it is contemplated that the impact attenuating structure 400 is formed with an ethylene-vinyl acetate material. However, as previously discussed, it is contemplated that any suitable material for an impact attenuating structure may be implemented.

FIG. 4 illustrates a cutline 5-5 that extends horizontally in a medial to lateral direction through the impact attenuating structure 400. The cutline 5-5 is a reference line for the aspects illustrated in the cross-sectional view of FIG. 5.

Figure 2:
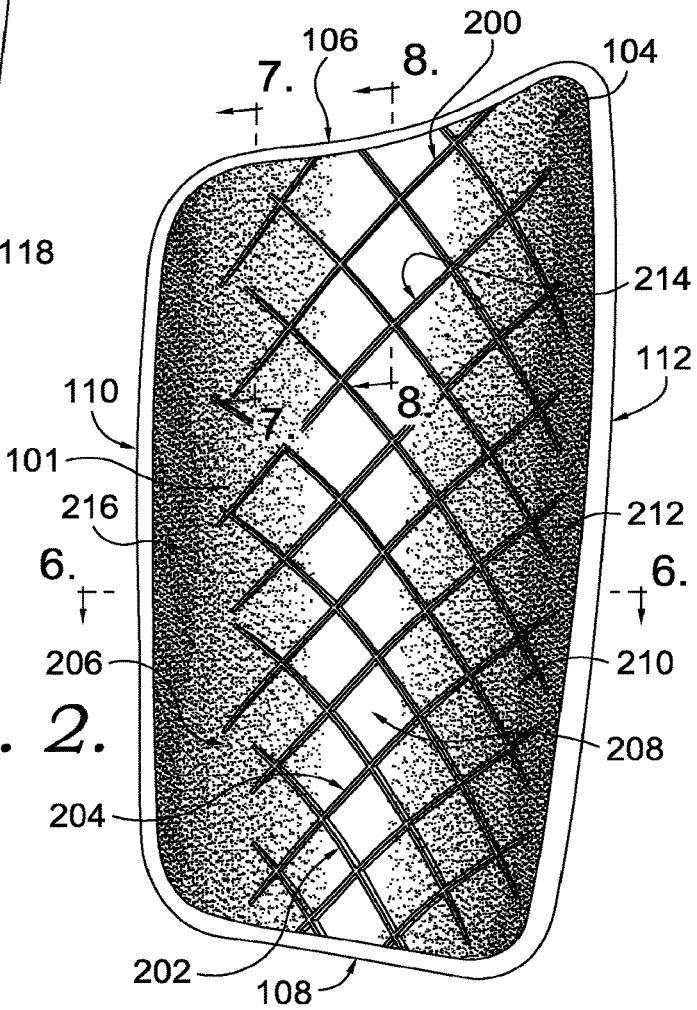
FIG. 2 illustrates a posterior perspective of a shell that exposes a posterior surface of a shell, in accordance with an aspect of the present invention.

Exemplary Protective Apparatus Including an Impact Attenuation Component Coupled to Impact Shell Having a Lattice FIG. 2 illustrates a posterior perspective of the shell 101 that exposes a posterior surface 104 of the shell 101, in accordance with an aspect of the present invention. As previously provided in the FIG. 1, the shell 101 is comprised of the superior edge 106, the inferior edge 108, the lateral edge 112, and the medial edge 110.

Further, the shell 101 is comprised of the lattice 200. As depicted, the lattice 200 extends/protrudes from the shell posterior surface 104. The surface formed from the protruding lattice 200 is referred to as the protrusion surface. In an exemplary aspect, the protrusion surface contacts an anterior surface of the impact attenuating structure, which offsets (e.g., spaces apart) the anterior surface of the impact attenuating structure from the posterior surface 104 of the shell 101. Consequently, the impact attenuating structure may contact the posterior surface 104 in locations where the lattice 200 fails to protrude a sufficient amount from the posterior surface 104.

The lattice 200 is comprised of a plurality of ribs (e.g., elements), such as a first rib 202 and a second rib 204. The first rib 202 may generally be described as extending from the inferior lateral direction towards the superior medial direction. The second rib 204 may generally be described as extending from the inferior medial direction towards the superior lateral direction. While a specific orientation and arrangement is depicted, it is contemplated that any size, shape, and orientation of ribs may be implemented in any combination to form a lattice that provides structural support for the shell and/or an offset between the shell posterior surface and the impact attenuating anterior surface. In an exemplary aspect, a first rib element and a second rib element intersect to form a portion of a lattice. It is contemplated that at the point of intersection, both the first rib element and the second rib element protrude an equal amount (e.g., create a similar offset) from the posterior surface.

The formation of the lattice 200 is contemplated as occurring during the manufacturing of the shell 101. For example, the lattice 200, in an exemplary aspect, is concurrently formed with the shell 101 in a common manufacturing process, such as molding (e.g., injection, compression, and the like) and additive manufacturing techniques (e.g., sintering, deposit). Therefore, the lattice 200 may be a mere feature of a uniform part that also forms the shell 101. Consequently, it is contemplated that the lattice 200 and the shell 101 are formed from a common material in a common manufacturing operation at the same time, in an exemplary aspect.

The shell 101 is comprised of several general regions identified as a medial portion 206, a middle portion 208, and a lateral portion 210. In an exemplary aspect, each of these regions/portions of the shell 101 may extend from the superior edge 106 to the inferior edge 108. Further, in an exemplary aspect, it is contemplated that the lattice 200 extends from the middle portion 208 outwardly in the medial-lateral direction to locations within the medial portion 206 and the lateral portion 210. The lattice 200 then terminates within the medial portion 206 and the lateral portion 210. The termination of the lattice may result based on the convergence of the protrusion surface 214 and the posterior surface 104 as the protrusion surface 214 descends into the posterior surface 104. As will be discussed in greater detail with FIGS. 6-8, a curve of the posterior surface 104 may be different (or have a different focal point) than that of a curve of the protrusion surface 214. This discrepancy in the curves defining the two surfaces, in an exemplary aspect, causes the lattice 200 to merge into the shell 101 as the lattice 200 extends laterally/medially from the middle portion 208. In an exemplary aspect, it is contemplated that the lattice 200 extends closer to the medial edge of the shell than the lateral edge of the shell before merging into the posterior surface to favor a tibia protecting area of the protection apparatus.

As will be discussed hereinafter with respect to FIG. 5, it is contemplated that the protective apparatus may be comprised of a medial affixing portion 216 and a lateral affixing portion 212. The affixing portions provide a location along the shell 101 posterior surface 104 in which the lattice 200 does not protrude from the posterior surface 104. The affixing portions 216 and 212, in an exemplary aspect, provide a location for coupling an impact attenuating structure to the shell 101.

FIG. 2 includes a cutline 6-6 extending horizontally from a medial to a lateral side of the shell 101. The cutline 6-6 is a reference line for the aspects illustrated in the cross-sectional view of FIG. 6 hereinafter. FIG. 2 also includes a cutline 7-7 extending in a vertical orientation within the medial portion 206. The cutline 7-7 is a reference line for the aspects illustrated in the cross-sectional view of FIG. 7 hereinafter. Additionally, FIG. 2 includes a cutline 8-8 extending in a vertical orientation within the middle portion 208. The cutline 8-8 is a reference line for the aspects illustrated in the cross-sectional view of FIG. 8 hereinafter.

Figure 3:
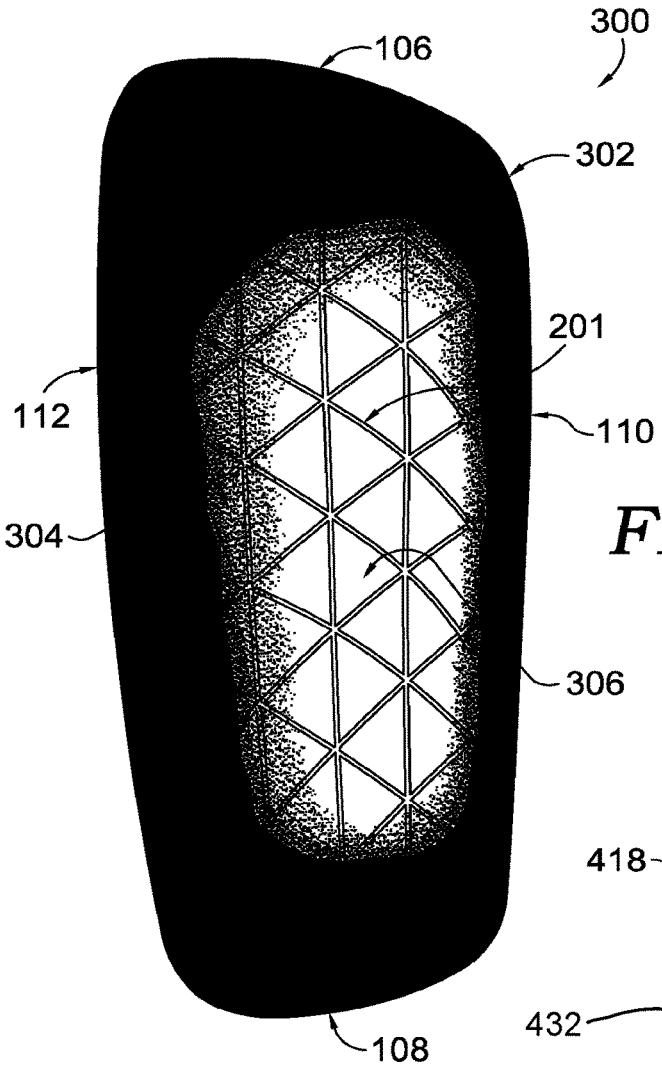
FIG. 3 depicts an anterior perspective of a partially obscured exemplary shell, in accordance with aspects of the present invention.

FIG. 3 depicts an anterior perspective of a partially obscured exemplary shell 300, in accordance with aspects of the present invention. The shell 300 is comprised of a superior edge 106, an inferior edge 108, a medial edge 110, and a lateral edge 112. Additionally, a lattice 201 is visible through a transparent portion 306. The lattice 201 protrudes in the posterior direction from the posterior surface of the shell 300.

As previously discussed, the shell 300 may be formed from a material that provides rigidity and resilience to deflect and disperse impact forces while still allowing for a transparency in portions, for reasons previously identified. However, because at least some of the bonding/coupling mechanisms that may be utilized (e.g., adhesives) to couple the shell 300 to an impact attenuating structure may be aesthetically unappealing as perceived through a transparent shell, a portion of the shell to which the coupling mechanism is utilized may be obscured or partially obscured. Further, ultraviolet energy that is able to pass through a transparent shell may have a detrimental effect on the bond created by a coupling mechanism. Therefore, to reduce the impact that radiation (e.g., sunlight) has on adhesives and other coupling mechanisms that may be affected by sunlight exposure, the portions of the shell that are utilized in the coupling process may be obscured or partially obscure to limit the effect of the light.

The shell 300 is depicted as having the transparent portion 306, an obscured portion 302, and a transition portion 304. The obscured portion 302 is depicted as emanating from the perimeter of the shell 300 inwardly toward a central region. It is contemplated that the obscured portion 302 corresponds with location in which the shell is coupled/affixed with an impact attenuating structure, at least in part. The transition portion 304 is a gradient of the applied masking material to transition into the transparent portion 306. The transition portion 304 may be utilized to partially filter a radiation source and/or to provide an aesthetically pleasing transition from the obscured to transparent portions.

While the term "obscured" is used, it is understood that any reduction in transmission of light relative to the transparent portion 306 is contemplated as being an "obscured" portion. Further, while a combination of the transparent portion 306, the transition portion 304, and the obscured portion 302 is depicted, it is contemplated that any combination or any portion individually may be implemented in any location in exemplary aspects.

Referring back to FIG. 4, in an exemplary aspect, it is contemplated that one or more channels on the posterior side of the impact attenuating structure 400 align with one or more corresponding ribs of a lattice on a posterior side of a shell. As a result, it is contemplated that as an impact force is experienced on an anterior surface of a shell, the force is transferred through the shell and the lattice to the impact attenuating structure 400. Because the lattice creates an offset between the impact attenuating structure 400 and the shell posterior surface, the translation of the force by the shell to the impact attenuating structure 400 may be concentrated at the locations at which the protrusion surface of the lattice contacts the impact attenuating structure 400. As such, it is contemplated that the one or more channels of the impact attenuating structure 400 that correspond to the lattice provide a deflection area allowing the impact attenuating structure 400 to deform at the channels to absorb at least a portion of the force before transferring the force through (and absorbing at least a portion of the force by) the impact attenuating structure 400. Stated differently, the channels may provide a natural deformation feature that distributes the concentrated force applied by the lattice across a greater area of the impact attenuating structure.

As discussed, the lattice may terminate into the posterior surface of the shell along the outer regions of the shell (e.g., within the medial portion and the lateral portion). However, it is contemplated that the corresponding channels may extend beyond (in the direction of the outer regions) of the impact attenuating structure. The extensions of the channels to a greater extent than the corresponding lattice portions may provide additional benefits. For example, it is contemplated that the channels provide ventilation between the impact attenuating structure and the wearer. Therefore, to fully ventilate moisture and air, it is contemplated that one or more channels may extend to the perimeter of the impact attenuating structure.

While not depicted, it is contemplated that a rib forming the lattice of a shell has a corresponding channel located on the impact attenuating structure in a location that aligns with the rib when the shell and the impact attenuating structure are coupled together. Additionally, it is contemplated that one or more channels may be included in the impact attenuating structures that do not correspond with a rib of the shell lattice. The non-associated channels may provide weight savings, additional ventilation, flexibility, and improved fit.

As previously indicated, FIG. 4 illustrates a cutline 5-5 that extends horizontally in a medial to lateral direction through the impact attenuating structure 400. The cutline 5-5 is a reference line for the aspects illustrated in the cross-sectional view of FIG. 5. FIG. 5 is a cross-section view of a protective apparatus 500 comprised of the impact attenuating structure 400 of FIG. 4, in accordance with aspects of the present invention. The protective apparatus is further comprised of a shell 103 having a lattice 203. The lattice 203 creates an offset 502 between a posterior surface of the shell 103 and an anterior surface of the impact attenuating structure 400, in one or more locations.

The impact attenuating structure 400 is comprised of the medial edge 410 and the lateral edge 412. The impact attenuating structure 400 is further comprised of a channel 414 (and other channels not individually identified). As depicted in FIG. 5, the impact attenuating structure 400 is contacting the posterior surface of the shell 103 proximate the medial edge 410 and the lateral edge 412. In an exemplary aspect, it is contemplated that an adhesive (e.g., glue, epoxy, tape) is applied in the medial and lateral portions of the shell between the respective edges and the termination of the lattice. As a result, the posterior surface of the shell and the anterior surface of the impact attenuating structure are coupled together. In an exemplary aspect, the anterior surface of the impact attenuating structure is not permanently couple with a protrusion surface of the lattice. Further, it is contemplated that the anterior surface of the impact attenuating structure is coupled with the posterior surface of the shell only in locations in which there is an obscured portion of an otherwise transparent shell. For example, a medial affixing location may be defined as a location proximate the medial edge that is suitable for affixing the shell and the impact attenuating structure together. Similarly, a lateral affixing location may be defined as a location proximate the lateral edge that is suitable for affixing the shell and the impact attenuating structure together.

The offset 502 represents a distance of separation between the anterior surface of the impact attenuating structure 400 and the posterior surface of the shell 103. In an exemplary aspect, the offset 502 correlates to a protrusion height of the lattice from the posterior surface of the shell 103. Therefore, as will be discussed in greater detail with respect to FIGS. 6-8 hereinafter, it is contemplate that the offset is greater in the middle portion of the shell 103 than the more medial and/or lateral portions of the shell 103.

Figure 6:
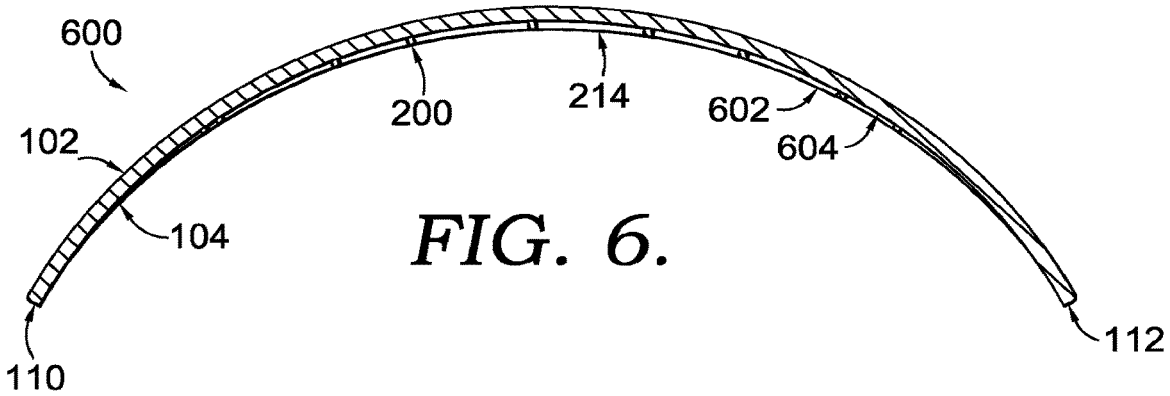
FIG. 6 illustrates a cross-sectional view of the shell in FIG. 2 along the cutline 6-6, in accordance with aspects of the present invention.

FIG. 6 is a cross-sectional view 600 of the shell 101 of FIG. 2 along the cutline 6-6, in accordance with aspects of the present invention. As previously discussed, the shell 101 is comprised of the medial edge 110, the lateral edge 112, the anterior surface 102, the posterior surface 104, the lattice 200, and the protrusion surface 214.

As discussed herein, it is contemplated that the protrusion surface 214 merges into the posterior surface 104, in an exemplary aspect. One method of merging in a predictable and eventual manner is achieved by having a general curve of the shell posterior surface 104 having a first diameter that is smaller than a general curve of the lattice protrusion surface 214. The general curve defining the posterior surface 104 has an approximate curve of 604 and the general curve defining the protrusion surface of the lattice has an approximate curve 602. For example, if the lattice curve 602 and the shell curve 604 have centers on a common axis that extends normal to the shell posterior surface 104 in the posterior direction from a middle position (medial to lateral) of the shell, when the shell curve 604 is of a smaller diameter than the lattice curve 602 and the lattice curve is more posterior at the point of the centerline axis extending from the shell, the further the lattice curve 602 extends in the medial to lateral direction from the centerline axis, the closer the lattice curve 602 will come to intercepting the shell curve 604. Stated differently, when the lattice curve 602 is larger than the shell curve 604, the lattice curve 602 will eventually intercept the shell curve 604. This interception in a three-dimensional space provides a merger of the two surfaces.

The additional lattice material (resulting in a greater offset) in the middle portion provide additional structural support in a region that is more likely to experience an impact force. Further, the raised lattice in the middle portion also provides a better distribution of a middle impact force across the width of the shell. Additionally, as less structural distribution is needed at the medial and lateral edges, a weight savings may be gained by limiting the material utilized in a lattice in those regions. Therefore, the varied offset created by the lattice across the width of the shell provides functional advantages that would not be gained by a constant offset, in an exemplary aspect.

Figure 7:
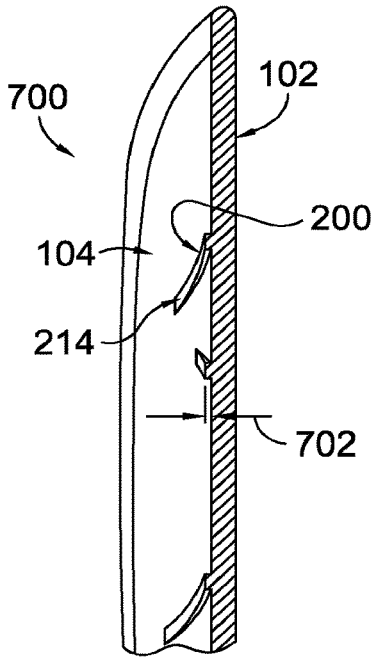
FIG. 7 illustrates a cross-section view of the shell in FIG. 2 along the cutline 7-7, in accordance with aspects of the present invention.

FIG. 7 is a cross-sectional view 700 of the shell 101 of FIG. 2 along the cutline 7-7, in accordance with aspects of the present invention. As previously discussed, the shell 101 is comprised of a posterior surface 104, an anterior surface 102, and a lattice 200. The lattice 200 forms the protrusion surface 214 that extends away in a posterior direction from the posterior surface 104. At the cutline 7-7, the protrusion surface 214 protrudes a first amount 702 from the posterior surface. The first amount 702 will be compared to a second amount 802 that will be discussed with respect to FIG. 8.

Figure 8:
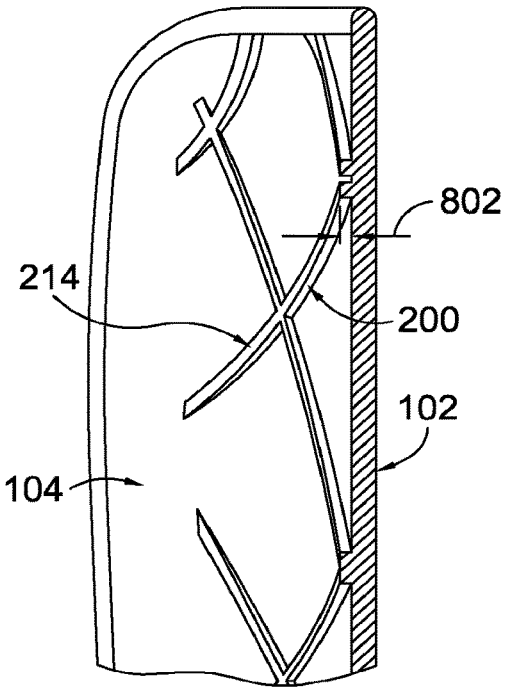
FIG. 8 illustrates a cross-sectional view of the shell in FIG. 2 along the cutline 8-8, in accordance with aspects of the present invention.

FIG. 8 is a cross-sectional view 800 of the shell 101 of FIG. 2 along the cutline 8-8, in accordance with aspects of the present invention. As previously discussed, the shell 101 is comprised of a posterior surface 104, an anterior surface 102, and a lattice 200. The lattice 200 forms the protrusion surface 214 that extends away in a posterior direction from the posterior surface 104. At the cutline 8-8, the protrusion surface 214 protrudes a second amount 802 from the posterior surface.

The first amount 702 of FIG. 7 is less than the second amount 802 of FIG. 8. The cutline 7-7 is closer to the medial edge than the cutline 8-8 on FIG. 2; therefore, in an exemplary aspect, the lattice is closer to intersecting the posterior surface 104 proximate the cutline 7-7 than at the cutline 8-8. Stated differently, the first amount 702 of FIG. 7 is smaller than the second amount 802 of FIG. 8 because the lattice structure is merging into the posterior surface 104 as the lattice extends towards the medial edge.

Exemplary Protective Apparatus Including an Impact Attenuation Component Coupled to an Articulated Impact Shell Referring to FIG. 9, another shell 1001 is depicted that may be coupled with the impact attenuation structure 400, instead of the shell 101. The shell 1001 includes a medial shell element 1016 and a separate lateral shell element 1014, at least in part. For example, it is contemplated that the medial shell element 1016 and the lateral shell element 1014 are the only two elements forming the entirety of the shell 1001, in an exemplary aspect. In this example, the medial shell element 1016 and the lateral shell element 1014 are connected by a flexible joint allowing for the shell to articulate about the joint (e.g., hinge). In an alternative aspect, it is contemplated that three or more elements may be used in conjunction to form the totality of the shell.

The medial shell element 1016 is comprised of a medial hinge edge 1020 that is opposite the medial edge 1012. The medial shell element 1016 extends from the superior edge 1006 to the opposite inferior edge 1008 and between the medial edge 1012 and the medial hinge edge 1020. A posterior surface and an anterior surface of the medial shell element 1016 form a portion of the respective posterior and anterior surfaces 1002 of the shell 1001.

Similarly, the lateral shell element 1014 is comprised of a lateral hinge edge 1018 that is opposite the lateral edge 1010. The lateral shell element 1014 extends from the superior edge 1006 to the opposite inferior edge 1008 and between the lateral edge 1010 and the lateral hinge edge 1018. A posterior surface and an anterior surface of the lateral shell element 1014 form a portion of the respective posterior and anterior surfaces 1002 of the shell 1001.

The lateral hinge edge 1018 and the medial hinge edge 1020 define an at least partial physical separation between the lateral shell element 1014 and the medial shell element 1016, which allows for the shell 1001 to flex and articulate as if hinged proximate the separation between the lateral hinge edge 1018 and the medial hinge edge 1020. This hinge (e.g., articulation joint) allows for a rigid or semi-rigid shell to conform to the shape of the wearer and to move with changes to the underlying form of the wearer (e.g., flexing of a calf muscle, differences in sock/sheath material thickness). Consequently, a common shell geometry may be offered to a variety of different consumers having different sizing needs as the hinged shell can adapt by articulating or bending while still having a functional shell.

While not identified explicitly in FIG. 9, it is contemplated that the impact attenuating structure 400, is coupled to the posterior surface of the shell 1001. The impact attenuating structure may serve several functions. For example, the impact attenuating structure may dissipate and attenuate an impact force experienced by the shell. Further, the impact attenuating structure may serve as a flexible hinge member between the medial shell element 1016 and the lateral shell element 1014. As a flexible hinge member, the impact attenuating structure allows the articulated protective apparatus to flex while maintain a spatial and relative relationship between the different shell elements.

FIG. 10 depicts a top-down view of an articulated protective apparatus 1000, in accordance with aspects of the present invention. In an exemplary aspect, the articulated protective apparatus 1000 is similar to that which was discussed with respect to FIG. 9 hereinabove. The articulated protective apparatus is comprised of a shell 1001 and an impact attenuating structure 1201 (which may include features similar to the impact attenuation structure 400). The shell 1001 is formed with a lateral edge 1010, a superior edge 1006, a medial edge 1012 and an inferior edge (obscured from view in FIG. 10). Further, the shell 1001 is comprised of a medial shell element 1016 and a lateral shell element 1014. The medial shell element is defined as extending between the medial edge 1012 and a medial hinge edge 1020. The lateral shell element 1014 is defined as extending between the lateral edge 1010 and a lateral hinge edge 1018. Further, the shell 1001 has a posterior surface 1004 and an anterior surface 1002.

The impact attenuating structure 1201 is comprised of an anterior surface 1204 and a posterior surface 1202. Further the impact attenuating structure 1201 is comprised of a superior edge 1206, a medial edge 1212, and a lateral edge 1210. As illustrated, it is contemplated that a continuous impact attenuating structure 1201 extends across both the medial shell element 1016 and the lateral shell element 1014. Therefore, the impact attenuating structure 1201 is functional to provide a flexible coupling between the medial shell element 1016 and the lateral shell element 1014. As illustrated, the lateral edge 1210 substantially aligns with the lateral edge 1010 and the medial edge 1212 substantially aligns with the medial edge 1012. However, it is contemplated that the shell 1001 may extend past one or more edges (e.g., superior, inferior, medial, lateral) of the impact attenuating structure 1201 and/or the impact attenuating structure 1201 may extend past one or more edges (e.g., superior, inferior, medial, lateral) of the shell 1001, in exemplary aspects.

The impact attenuating structure 1201 is also comprised of a number of channels (e.g., grooves, recesses) along at least the posterior surface 1202. The channels may extend in any direction, for any length, at any depth, and at any geometry. In an exemplary aspect, a hinge channel 1302 extends from the superior edge 1206 downwardly towards an inferior edge of the impact attenuating structure 1201. In an exemplary aspect, the hinge channel is substantially parallel with at least one of the medial hinge edge 1020 and/or the lateral hinge edge 1018. Similarly, it is contemplated that the hinge channel 1302 is aligned with a midline spaced evenly between the medial edge 1212 and the lateral edge 1210, so as to be substantially aligned with and positioned proximate to an articulation joint between the medial shell element 1016 and the lateral shell element 1014. The hinge channel 1302, in an exemplary aspect, provides a crease line along the impact attenuating structure 1201 that is more prone to bending than non-channel portions of the impact attenuating structure 1201 proximate the articulation joint. Therefore, the hinge channel 1302 serves as a hinge for the medial shell element 1016 and the lateral shell element 1014. Stated differently, the impact attenuating structure 1201 proximate the hinge channel 1302 serves as an articulating member to which the shell elements are coupled, but remain physically independent of one another.

In addition to the hinge channel 1302, a medial channel 1304 and a lateral channel 1306 are also depicted. The medial channel 1304 and the lateral channel 1306 may also extend from the superior edge to the inferior edge of the impact attenuating structure 1201 in a substantially parallel manner to the hinge channel 1302. It is contemplated that the medial channel 1304 may recess into the impact attenuating structure 1201 a first amount, the hinge channel 1302 may extend into the impact attenuating structure 1201 a second amount, as depicted. In this example, the medial channel 1304 may recess into the impact attenuating structure 1201 a lesser amount than the hinge channel 1302. Similarly, the lateral channel 1306 may recess a third amount into the impact attenuating structure 1201. It is contemplated that the first amount, the second amount, and the third amount are different amounts. Further, it is contemplated that first amount is different from the second amount and the third amount, wherein the second amount and the third amount are substantially similar amounts.

The degree of recess of a channel may be altered to accomplish a variety of goals. For example, it is contemplated that the medial channel 1304 is more closely oriented to the wearer's tibia bone (i.e., shin) in an as-worn position. Therefore, the reduction in the channel depth increases a volume of impact attenuating material that is effective for attenuating an impact force across the tibia. The greater degree of recess of the hinge channel 1302 may allow for the impact attenuating structure 1201 to articulate at the hinge channel with greater ease than a shallower recess depth. Further, the greater depth of the hinge channel 1302 and the lateral channel 1306 may provide for greater ventilation along the wearer's body and a reduction in weight from a reduction in material of the impact attenuating structure 1201.

While the concepts provided herein discuss the concept of a protection apparatus and depict a shin guard in particular, it is contemplated that this concept extends to all types of force attenuation applications. Additionally, the term "proximate" has been used herein. Proximate is a spatial term that is intended to reflect a locational sense of being close to, near, approximately at, and the like.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A protective apparatus comprising:

a first shin guard and a second shin guard, wherein the first shin guard is a mirror image of the second shin guard, and wherein each of the first shin guard and the second shin guard includes an impact shell and an impact attenuating surface;

the impact shell having an anterior surface, an opposite posterior surface, a medial edge, an opposite lateral edge, a superior edge, and an opposite inferior edge; and the impact attenuating structure being less rigid than the impact shell and including an anterior surface adhered to the posterior surface of the impact shell, the impact attenuating structure including a plurality of grooves positioned in a posterior surface of the impact attenuating structure, wherein the impact attenuating structure includes a medial edge, a lateral edge, a superior edge, an inferior edge, and a midline spaced evenly between the medial edge and the lateral edge;

wherein a first groove and a second groove in the plurality of grooves extend from the superior edge of the impact attenuating structure to the inferior edge of the impact attenuating structure;

wherein the first groove is positioned on a medial side between the midline and the medial edge, and the second groove is positioned on a lateral side between the midline and the lateral edge;

wherein the first groove positioned closer to the medial edge includes a shallower groove depth than the second groove, such that a first thickness of impact attenuating structure between the first groove and the anterior surface of the impact attenuating structure is larger than a second thickness of impact attenuating structure between the second groove and the anterior surface of the impact attenuating structure; and wherein a larger distribution of the impact attenuating structure is on the medial side of the impact attenuating structure than the lateral side of the impact attenuating structure.

2. The protective apparatus of claim 1, wherein the impact attenuating structure is a foam-based material.

3. The protective apparatus of claim 2, wherein the impact attenuating structure is formed from an ethylene-vinyl acetate material.

4. The protective apparatus of claim 1, wherein the impact shell is formed from at least one material selected from the following:

a) a polypropylene material;

b) a styrene-butadiene copolymer material; or c) a carbon fiber-based material.

5. The protective apparatus of claim 1, wherein three or more grooves in the plurality of grooves are arranged between the first groove and the second groove.

6. The protective apparatus of claim 5, wherein at least one of the three or more grooves is a hinge groove, and wherein a respective shin guard is configured to bend along the hinge groove to conform to a wearer's shin.

7. The protective apparatus of claim 6, wherein the hinge groove is aligned with the midline.

8. The protective apparatus of claim 1, wherein the medial side with the larger distribution is configured to align with a tibia bone of a wearer, and the lateral side is configured to align with a non-bone leg region of the wearer.

9. A shin guard comprising:

an impact shell having an anterior surface, an opposite posterior surface, a medial edge, an opposite lateral edge, a superior edge, and an opposite inferior edge; and an impact attenuating structure that is less rigid than the impact shell and includes an anterior surface adhered to the posterior surface of the impact shell, the impact attenuating structure including a plurality of grooves positioned in a posterior surface of the impact attenuating structure, wherein the impact attenuating structure includes a medial edge, a lateral edge, a superior edge, an inferior edge, and a midline spaced evenly between the medial edge and the lateral edge;

wherein the plurality of grooves extend from the superior edge of the impact attenuating structure to the inferior edge of the impact attenuating structure; wherein the plurality of grooves includes a medial groove, a lateral groove, and a hinge groove positioned between the medial groove and the lateral groove, the hinge groove aligned with the midline of the impact attenuating structure;

wherein the medial groove is positioned closest to the medial edge relative to any other groove of the plurality of grooves and the lateral groove is positioned closest to the lateral edge relative to any other groove of the plurality of grooves;

wherein, when in use by a wearer, the shin guard is configured to bend along the hinge groove to conform to a shin of the wearer and to align the medial groove with a tibia bone of the wearer; and wherein the medial groove includes a shallower groove depth than the lateral groove, such that a first thickness of impact attenuating structure between the medial groove and the anterior surface of the impact attenuating structure is larger than a second thickness of impact attenuating structure between the lateral groove and the anterior surface of the impact attenuating structure.

10. The shin guard of claim 9, wherein the medial groove is positioned closer to the medial edge relative to any other groove in the posterior surface of the impact attenuating structure, and wherein the lateral groove is positioned closest to the lateral edge relative to any other groove in the posterior surface of the impact attenuating structure.

11. A shin guard comprising:

an impact shell having an anterior surface, an opposite posterior surface, a medial edge, an opposite lateral edge, a superior edge, and an opposite inferior edge; and an impact attenuating structure that is less rigid than the impact shell and includes an anterior surface adhered to the posterior surface of the impact shell, the impact attenuating structure including a plurality of grooves positioned in a posterior surface of the impact attenuating structure, wherein the impact attenuating structure includes a medial edge, a lateral edge, a superior edge, and an inferior edge;

wherein a first groove and a second groove in the plurality of grooves extend from the superior edge of the impact attenuating structure to the inferior edge of the impact attenuating structure;

wherein the plurality of grooves includes one or more grooves between the first groove and the second groove;

wherein the one or more grooves between the first and second grooves comprises a hinge groove, and wherein the shin guard is configured to bend along the hinge groove to conform to a shin of a wearer, wherein the first groove is positioned closer to the medial edge relative to any other groove in the posterior surface of the impact attenuating structure, and wherein the second groove is positioned closer to the lateral edge relative to any other groove in the posterior surface of the impact attenuating structure;

wherein the first groove is positioned closer to the medial edge than the second groove and is configured to align with a tibia bone of the wearer;

wherein the first groove includes a shallower groove depth than the second groove, such that a first thickness of impact attenuating structure between the first groove and the anterior surface of the impact attenuating structure is larger than a second thickness of impact attenuating structure between the second groove and the anterior surface of the impact attenuating structure.

12. The shin guard of claim 11, wherein the one or more grooves between the first groove and the second groove comprises at least three grooves.

* * * * *